US007051784B2

(12) United States Patent
Aoyama et al.

(10) Patent No.: US 7,051,784 B2
(45) Date of Patent: May 30, 2006

(54) METHOD OF PRODUCING SEMI-SOLID METAL SLURRIES

(75) Inventors: Shunzo Aoyama, Tokyo (JP); Chi Liu, Tokyo (JP); Toshiyuki Sakazawa, Tokyo (JP); Ye Pan, Tokyo (JP)

(73) Assignee: Ahresty Corp., Tokyo (JP)

( * ) Notice: Subject to any disclaimer, the term of this patent is extended or adjusted under 35 U.S.C. 154(b) by 0 days.

(21) Appl. No.: 10/277,992

(22) Filed: Oct. 23, 2002

(65) Prior Publication Data

US 2003/0062144 A1 Apr. 3, 2003

Related U.S. Application Data

(63) Continuation of application No. 09/421,931, filed on Oct. 21, 1999, now abandoned, which is a continuation of application No. 08/993,566, filed on Dec. 18, 1997, now abandoned.

(30) Foreign Application Priority Data

Jul. 24, 1997 (JP) ..... 9-198698

(51) Int. Cl.
*B22D 17/00* (2006.01)

(52) U.S. Cl. ..... 164/113; 164/900; 164/71.1; 164/122

(58) Field of Classification Search ..... 164/113, 164/90, 71.1, 122, 900; 148/549, 538
See application file for complete search history.

(56) References Cited

U.S. PATENT DOCUMENTS 4,607,682 A * 8/1986 Dantzig et al. ..... 164/418
4,938,052 A * 7/1990 Young et al. ..... 72/361
5,662,156 A * 9/1997 Freeman ..... 164/61

FOREIGN PATENT DOCUMENTS

EP 0392998 * 10/1990
EP 745694 * 12/1996 ..... 164/113

* cited by examiner

*Primary Examiner*—Kevin Kerns
*Assistant Examiner*—I.-H. Lin
(74) *Attorney, Agent, or Firm*—Dykema Gossett PLLC

(57) ABSTRACT

By determining an amount of a metal to be prepared into a slurry in its liquid state, thereafter applying a motion to the melted metal via a mechanical or physical means when at least a part of the melted metal reaches a temperature below the liquidus temperature and cooling the melted metal in a slurry preparing container to prepare the melted metal into a metal slurry in a semi-solid state, and by concurrently making the semi-solid metal slurry in the slurry preparing container with a shape to be kept almost unchanged, and feeding the semi-solid metal slurry in a state wherein the shape is nearly kept as it is into the shot sleeve/prechamber of the part making machine, a semi-solid metal slurry with the non-dendritic (spherical) primary crystal particles being fine and almost uniform can be fed into the part making machine, with no need of any specifically complex process but with a simple system and plain equipment. Thus, a shaped part with high quality can be produced.

6 Claims, 13 Drawing Sheets

(a)

(b)
UPPER
PART (b)
CENTRAL
PART (a) CENTRAL PART (a) SUPERFICIAL LAYER PART (b) CENTRAL PART (b) SUPERFICIAL LAYER PART

METHOD OF PRODUCING SEMI-SOLID METAL SLURRIES

CROSS REFERENCE TO RELATED APPLICATIONS

This application is a continuation of application Ser. No. 09/421,931, filed Oct. 21, 1999, now abandoned, which was a continuation of application Ser. No. 08/993,566, filed Dec. 18, 1997 now abandoned. All priorities are requested.

FIELD OF THE INVENTION AND RELATED ART STATEMENT

The present invention relates to rheocasting and thixocasting in mushy/semi-solid state of metals using high pressure part making machines. (Herein, "high pressure part making machine" is simply referred to as "part making machine".)

More specifically, rheocasting is a process of producing a shaped part, comprising cooling a melted metal to a temperature range in which solids and liquids can be present concurrently, and charging the resultant metal slurry into the shot sleeve/prechamber of a part making machine. Thixocasting is a process of producing a shaped part, comprising reheating a solid metal slug to a temperature range in which solids and liquids are concurrently present, and charging the resultant metal slurry into the shot sleeve/prechamber of a part making machine.

Preferably, the metal slurry to be used in the semi-solid process is in a state that the primary crystals are separately distributed throughout in a liquid matrix, and the primary crystal particles are as fine as possible and as uniformly non-dendritic as possible, preferably spherical. In that case, the metal slurry can be processed while being kept in a semi-solid state with a low viscosity and with a high fraction solid, whereby the shrinkage cavity/porosity in the resultant parts can be effectively decreased and the mechanical properties of the parts can be enhanced.

As disclosed in the Japanese Patent Laid-open No. Hei 7-32113, therefore, a process of preparing a semi-solid metal slurry has been proposed by using a rheomaker, comprising cooling a melted metal in the rheomaker under being stirred. By the process, however, the metal slurry is prepared into a semi-solid state, and thereafter, an amount thereof to be processed is separated and determined. Therefore, it is difficult to sharply cut the semi-solid metal slurry, so that the determination of an amount of the semi-solid metal slurry is inevitably difficult. Thus, the amount of the semi-solid metal slurry to be supplied easily varies. Due to such variation, the processing conditions will be changed. For these reasons, the quality of the resultant parts is not stable, disadvantageously. Furthermore, the semi-solid metal slurry is easily attached and then deposited on a slurry discharge outlet, and therefore, the operation of the opening and closing valve of the slurry discharge outlet immediately fails. Thus, the stable supply of the semi-solid metal slurry is difficult, and the shape deformation of the resultant semi-solid metal slurry via gravitative attraction is poorer than the deformation of its liquid substance, so that it is difficult to charge the semi-solid metal slurry into the shot sleeve/prechamber of a part making machine. Additionally, the shape is unstable. Hence, the charging of the semi-solid metal slurry in its entirety is very difficult, involving difficulty in feeding stably the semi-solid metal slurry into the shot sleeve/prechamber of a part making machine. Furthermore, the temperature control until the semi-solid metal slurry prepared in a rheomaker is charged into the shot sleeve/prechamber of a part making machine is difficult, disadvantageously.

In such circumstances, the present inventors have found a method to granulate the primary crystal based on some fundamental experiments. Consequently, the inventors have theoretically elucidated the process of preparing a semi-solid metal slurry and the conditions therefor, which have been determined empirically up to now. Consequently, the inventors have found a process suitable for supplying a semi-solid metal slurry and the conditions therefor. Thus, a process of semi-solid slurry making which can be practiced industrially at a large scale has been developed. The present invention has a meaning at that point.

OBJECT AND SUMMARY OF THE INVENTION

It is an object of the present invention to provide a semi-solid slurry making method for stably preparing a semi-solid metal slurry with primary crystal particles being fine and almost uniformly non-dendritic (spherical) with a simple system and plain equipment with no particular need of complex procedures and thereafter supplying the slurry stably into a part making machine, the semi-solid slurry making of metals can be easily practiced industrially.

The semi-solid metal making of the present invention, which can achieve the object described above, is characterized that an amount of a metal to be prepared into a slurry is determined in its liquid state, and the determined melted metal is thereafter cooled in a slurry-preparing container to prepare the metal as a metal slurry in a semi-solid state, while concurrently making preliminarily the semi-solid metal slurry in the slurry-preparing container into a shape which can be charged as it is into the shot sleeve/prechamber of a part making machine, and charging the metal slurry into the shot sleeve/prechamber of the part making machine and processing the metal slurry therein in the semi-solid state while the slurry "nearly" keeping its shape.

Then, a motion is applied through a mechanical or physical means to the melted metal, in the course of cooling and when at least a part of the melted metal is lowered at a temperature below the liquidus temperature. And thereafter, the melted metal is cooled and thereby becomes a semi-solid state.

More specifically, by making the melted metal flow over the slope face of a cooling device, a motion is applied to the melted metal while at least a part of the melted metal is at a temperature below the liquidus temperature; or by pouring the melted metal into a slurry-preparing container when at least a part of the melted metal is at a temperature below the liquidus temperature, such motion is applied to the melted metal; or by applying supersonic vibration to the melted metal placed in the slurry-preparing container directly or from the outside wall of the slurry-preparing container, such motion is applied to the melted metal.

As the slurry-preparing container to be used in the present invention, plural containers are used, each of a tubular shape can be divided into halves, and slurry-preparing containers are satisfactorily fed into the shot sleeve/prechamber of a part making machine one by one so that the individual slurry-preparing container might reach the charge inlet of the shot sleeve/prechamber of the part making machine, just in time when the semi-solid metal slurry prepared in the slurry-preparing container attains a predetermined fraction solid. Furthermore, the slurry-preparing container is satisfactorily made into a tubular shape with a bottom or into a tubular shape, comprising a thin metal plate, which is then charged integrally with the semi-solid metal slurry into the shot sleeve/prechamber of the part making machine.

In the present specification, herein, the term "time just at a temperature below the liquidus temperature" means the time when the temperature of melted metal passes through the liquidus temperature for the first time.

In the course of cooling, the melted metal shows a phenomenon called as undercooling that the temperature is lowered slightly below the liquidus temperature and then is increased back to the liquidus temperature. The phenomenon occurs when a large quantity of nuclei for the primary crystal of the melted metal generate instantly below the liquidus temperature because that release of latent heat due to solidification then heats the metal, so that the temperature is increased.

However, the present inventors have found that no undercooling phenomenon occurs if an appropriate motion is applied to the melted metal around the liquidus temperature. And then, the inventors have found that by gradually cooling the melted metal starting from the state with no occurrence of the undercooling phenomenon, the metal microstructure is in a granular crystal form instead of dendritic morphology. This may possibly be because a great number of the nuclei of the primary crystal are simultaneously generated by applying an appropriate motion to the melted metal around the liquidus temperature, particularly at a temperature below the liquidus temperature, and concurrently, the interdependency of the nucleated crystal nuclei with the crystal growth direction is eliminated so that the every crystal nuclei of the primary crystal randomly get their crystal orientations which has not yet been elucidated in the prior art.

DETAILED DESCRIPTION OF PREFERRED EMBODIMENTS

Figure 1:
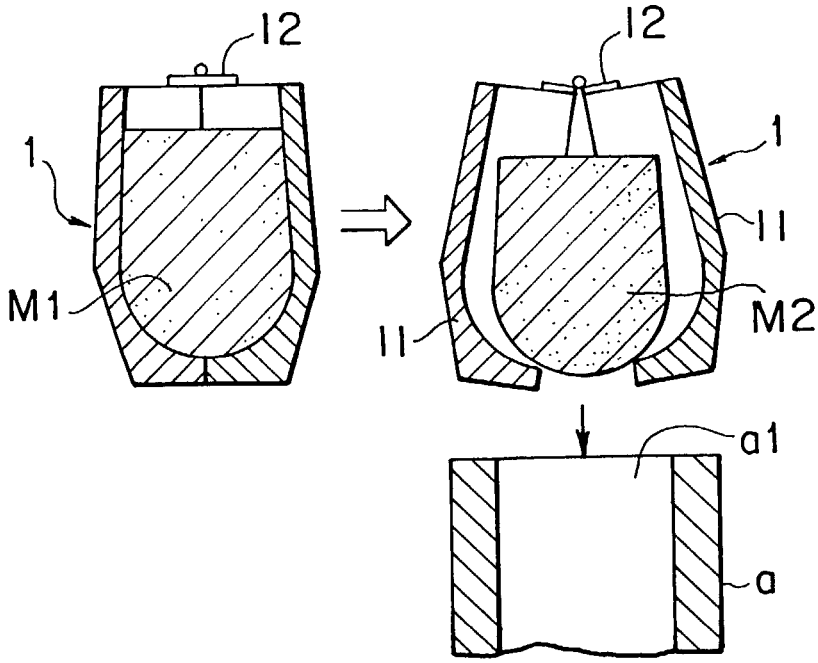
FIGS. 1 to 3 are schematic views of a specific example of a slurry-preparing container in accordance with the present invention.

The semi-solid metal making of the present invention will be described below with reference to drawings, but the invention is not limited to these examples.

The melted metal to which the present invention is applicable includes metals such as aluminium and the alloys thereof, or magnesium alloys, zinc alloys, cooper or the alloys thereof, iron alloys or the like.

An amount of a metal to be prepared is determined in its liquid state, and thereafter, the melted metal is cooled in a slurry preparing container, to prepare the metal as a semi-solid metal slurry. Then, a motion is applied to the melted metal within a temperature range predetermined correspondingly to each melted metal, more specifically when at least a past of each melted metal reaches a temperature below the liquidus temperature in the course of cooling of the melted metal, and then by cooling the melted metal at a predetermined rate, a metal slurry in a semi-solid state can be prepared.

Then, a ratio of a part of the melted metal placed in the container at a temperature below the liquidus temperature is preferably larger. In other words, a motion is applied to the melted metal placed in the container below the liquidus temperature and with a temperature distribution as uniform as possible. When the melted metal placed in the container is cooled, the cooling rate is preferably slowed down to make the temperature distribution in the melted metal as uniform as possible.

As a method to apply a motion to the melted metal, any mechanical or physical means may be possible. More specifically, the following method s are possible; 1. a method for applying a motion to the melted metal, comprising pouring the melted metal drawn up from a reservoir furnace into a slurry-preparing container; 2. a method for applying a motion to the melted metal, comprising placing a given amount for example, an amount required for one shot of the melted metal in a slurry-preparing container and vibrating mechanically the slurry-preparing container to apply a motion to the melted metal therein; 3. a method for applying a motion to the melted metal, comprising giving supersonic vibration to the melted metal in the slurry-preparing container, directly or from the outside wall of the slurry-preparing container; 4. a method for applying a motion to the melted metal, comprising stirring the melted metal in the slurry-preparing container by using a high frequency induction stirring apparatus; 5. a method for applying a motion to the melted metal, comprising mechanically stirring the melted metal placed in the slurry-preparing container with a stirring bar or a stirring vane or the like; 6. a method for applying a motion to the melted metal, comprising magnetically stirring the melted metal placed in the slurry-preparing container; 7. a method for applying a motion to the melted metal, comprising blowing inert gas and the like into the melted metal placed in the slurry-preparing container; or 8. a method for applying a motion to the melted metal, comprising inducing explosion in the melted metal placed in the slurry-preparing container; or the like.

When a motion is applied to the melted metal by pouring the melted metal into the slurry-preparing container, the melted metal is drawn up with a drawing vessel such as ladle or melt metal reservoir, subsequently cooled to a predetermined temperature, and is them poured into the slurry-preparing container. When the melted metal is poured into the slurry-preparing container, at least a part of the melted metal is satisfactorily at a temperature below the liquidus temperature.

When a motion is applied to the melted metal by pouring the melted metal into the slurry preparing container, the melted metal is drawn up with a drawing vessel such as ladle or melt metal reservoir, subsequently cooled to a predetermined temperature, and is then poured into the slurry preparing container. When the melted metal is poured into the slurry preparing container, at least a part of the melted metal is satisfactorily at a temperature below the liquidus temperature.

When a motion is practically applied to the melted metal, herein, any one of the methods 1 to 8 may be adopted satisfactorily. However, a combination of two or more of these methods may be adopted, satisfactorily, and by an appropriately selected combination of the aforementioned methods depending on the structure elements of a semi-solid metal slurry making system, a motion can be applied to the melted metal, effectively.

After a motion is applied to the melted metal at a given time (temperature range) in such a manner, the melted metal is cooled at an appropriate cooling rate in the slurry preparing container. If the cooling rate of the melted metal is too quick, the temperature un-uniform is induced in the metal slurry, so that the fraction solid of the resultant metal slurry is also un-uniform. If the metal slurry is used to produce a part the slurry flow is disordered during filling due to the difference in the fluidity, thus inducing air wrapping, or defects due to shrinkage easily occur because of the difference of the fraction solid. Therefore, preferably, the cooling rate of the melted metal is slow. More specifically, the melted metal is cooled at a cooling rate of 3° C./sec or less, preferably 0.4° C./sec or less. In that case, the primary crystal can grow spherically, and almost uniformly granulated primary crystals can be obtained in a stable fashion. Simultaneously, the duration in which the semi-solid metal slurry is within the most appropriate temperature range for rheocasting can be prolonged. Hence, the time when the semi-solid metal slurry prepared in the slurry preparing container is fed to the shot sleeve/prechamber of a part making machine can be adjusted readily to accommodate to the making cycle of the part making machine. Additionally, even if the making cycle of the part making machine is more or less disordered, a semi-solid metal slurry with an almost constant fraction solid can be fed to the shot sleeve/prechamber of the part making machine.

The slurry preparing container in accordance with the present invention is preferably made into a structure with an approximate volume enough to place the amount of a melted metal for one shot, and with such a shape and a structure that the semi-solid metal slurry prepared therein can be readily charged into the shot sleeve/prechamber of a part making machine while the shape is approximately kept as it is.

Figure 2:
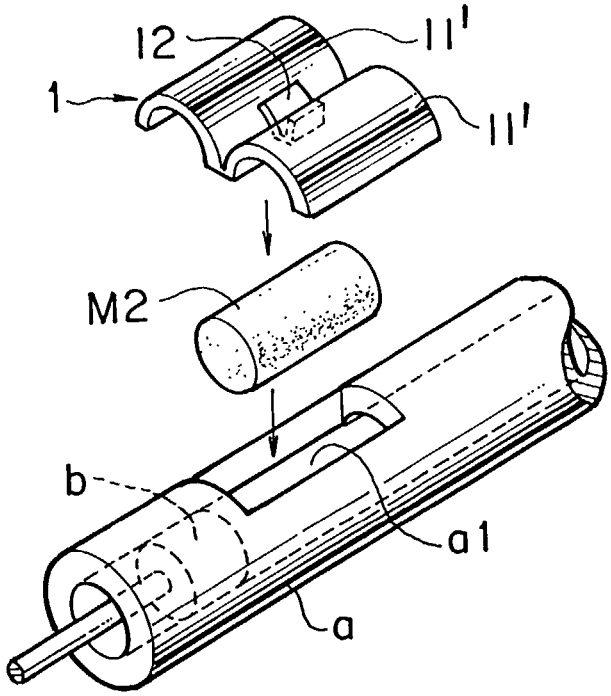

More specifically, slurry-preparing container 1 shown in FIG. 1 is made, by vertically arranging member 11 of a block structure in halves along the axis direction and linking (the halves of) the member together by means of hinge 12 in such a manner that the member can be divided and opened and closed in the left and right direction. Then, the inner diameter is formed to be slightly smaller than charge inlet "a1" of shot sleeve/prechamber "a" of part making machine. Additionally, slurry-preparing container 1 as shown in FIG. 2 is made, by arranging along the horizontal direction two members 11' of a divided structure and linking the members along the left and right direction so that the members can be separated and opened and closed. In this case, the inner shape is formed to be slightly smaller than the charge inlet "a1" of the shot sleeve/prechamber "a" of a part making machine. The slurry-preparing container 1 as the former can readily accommodate to a part making machine of a longitudinal injection type where shot sleeve/prechamber "a" is arranged vertically; the latter slurry-preparing container 1 can easily accommodate to a part making machine of a crosswise injection type where shot sleeve/prechamber "a" is arranged along the horizontal direction.

In the face of inner periphery of the slurry-preparing container a fine ceramic material, such as silicon nitride, SIALON, alumina magnesia, which does not react on the melted metal, is preferably coated. In that case, the melted metal is not dirtied due to the reaction of the slurry-preparing container and the melted metal.

On a part of the face of the inner periphery of the slurry-preparing container which is in contact to the melted metal, a solid lubricant such as graphite is coated or a powdery thermal insulation agent is coated in a dried powder state, preferably. In that case, the melted metal fed into the slurry-preparing container will not be attached on the face of the inner periphery, and thus, the semi-solid metal slurry prepared in the slurry-preparing container can be readily dissociated and discharged; concurrently, the cooling rate of the melted metal placed in the slurry-preparing container is slowed down to promote the uniformity of the temperature. Additionally, it is also satisfactory that the slurry-preparing container is made into a tubular shape with a bottom and with the upper top being opened, having a given size (volume), through deep drawing process using a thin metal plate or through impact shaping, or the slurry-preparing container is formed into an appropriate length by using a metal pipe while the bottom part is freely opening and closing. And then, the resultant slurry-preparing container is charged together with the semi-solid metal slurry prepared therein into the shot sleeve/prechamber of a part making machine.

When a metal sheet is made into a tubular shape with both the ends occluded with a pushing plate, the melted metal may satisfactorily be poured into the metal sheet at a horizontal state. In that case, it is easier to charge the metal slurry in a semi-solid state into the shot sleeve/prechamber of a part making machine, because the metal slurry is prepared in the slurry-preparing container, and the shape of the slurry is nearly kept. Then, the slurry-preparing container is formed from a metal material with a higher melting point than that of the melted metal placed therein (more specifically, if the melted metal is an aluminum alloy, for example, the container is formed from a steel material). Otherwise, the container is formed from a metal material of the same matrix as the melted metal placed therein. If the slurry-preparing container is formed from a metal material with a higher melting point than that of the melted metal placed therein, the slurry-preparing container itself is absolutely never melted in contact to the melted metal even if the container is formed from a plate material of a thin thickness. If the slurry-preparing container is formed from a metal material of the same matrix as the melted metal, the semi-solid metal slurry prepared in the slurry-preparing container is fed into the shot sleeve/prechamber of a part making machine, integrally together with a slurry-preparing container, and the slurry-preparing container integrated with the gate and biscuit of a made part can be remelted without any special treatment. Additionally, the composition variation due to reuse of the scrap can be reduce less, and therefore the scrap can be recycled readily.

Figure 3:
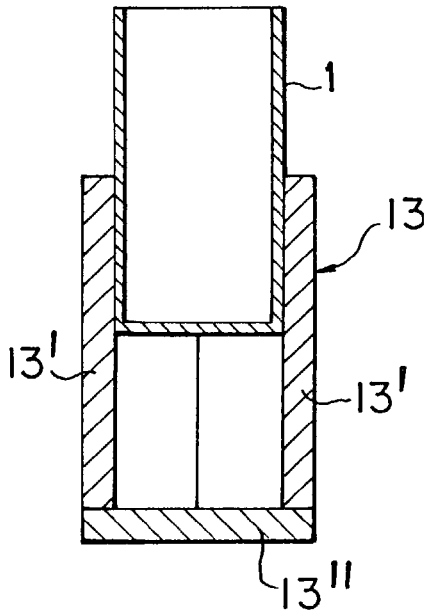

So as to easily discharge the semi-solid metal slurry prepared in the slurry-preparing container together with the slurry-preparing container, holder 13 to support the slurry-preparing container as shown in FIG. 3 is used, the bottom part of the holder 13 may be structured in a free motion of opening and closing with an opening and closing lid, or the holder 13 may be divided into two or more parts, which can be opened and closed. In the Example shown in FIG. 3, herein, tubular part 13' composing the holder 13 is formed in a manner that the part is divided into two along the axis direction to be opened and closed, and additionally, bottom plate 13" thereof is of such a structure that the plate can be separated from the tubular part 13' and can be opened and closed.

In such a manner, the semi-solid metal slurry prepared in the slurry-preparing container may be drawn out form the slurry-preparing container and be then fed into the shot sleeve/prechamber of a part making machine, or the slurry together with the slurry preparing container may be fed into the shot sleeve/prechamber of a part making machine. In any event, the semi-solid metal slurry is made in a form, for example, tubular shape or bullet shape, and the slurry with the slurry-preparing container can be fed into the shot sleeve/prechamber of a part making machine while the slurry keeps its shape, whereby a part can be made.

As routinely carried out, the semi-solid metal slurry "M2" may satisfactorily be charged then from charge inlet "a1" into the shot sleeve/prechamber "a". However, the slurry may satisfactorily be fed into the shot sleeve/prechamber "a" from the divided face (parting surface) of a mold, particularly when a part making machine of a crosswise injection type is used. In such case, it is not necessary to lengthen the shot sleeve or change the shape of the charge inlet "a1", so as to feed the semi-solid metal slurry "M2" into the shot sleeve "a" while the shape of the metal slurry can be kept as it is. Accordingly, conventional shot sleeve can be used without any changes.

The fraction solid of the semi-solid metal slurry "M2" is preferably controlled in a range from 0.3 to 0.8. If the fraction solid is not more than 0.3, the metal slurry has a lower viscosity so that the flow of the slurry is disordered when the slurry is filled under pressure into a mold cavity, readily involving air wrapping, whereby the solidification shrinkage thereof is increased to easily develop a shrinkage defect in the made part. If the fraction solid is above 0.8, unpreferably, the metal slurry has a too high viscosity so that the fluidity is significantly lowered to cause difficulty in entirely filling the semi-solid metal slurry "M2" into the mold cavity.

Figure 5:
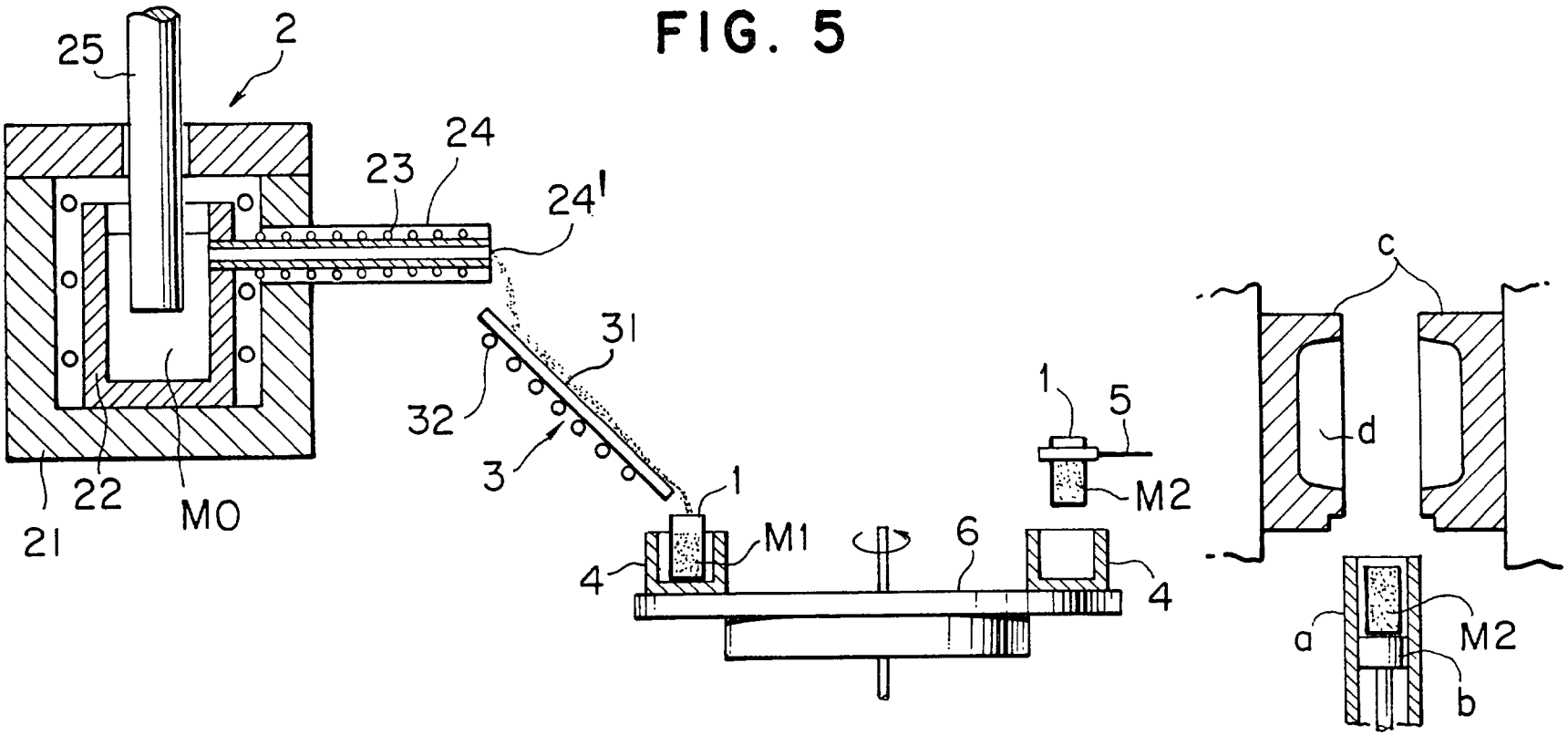
FIG. 5 is a schematic front view describing a preferable example for preparing and processing a semi-solid metal slurry.
Figure 6:
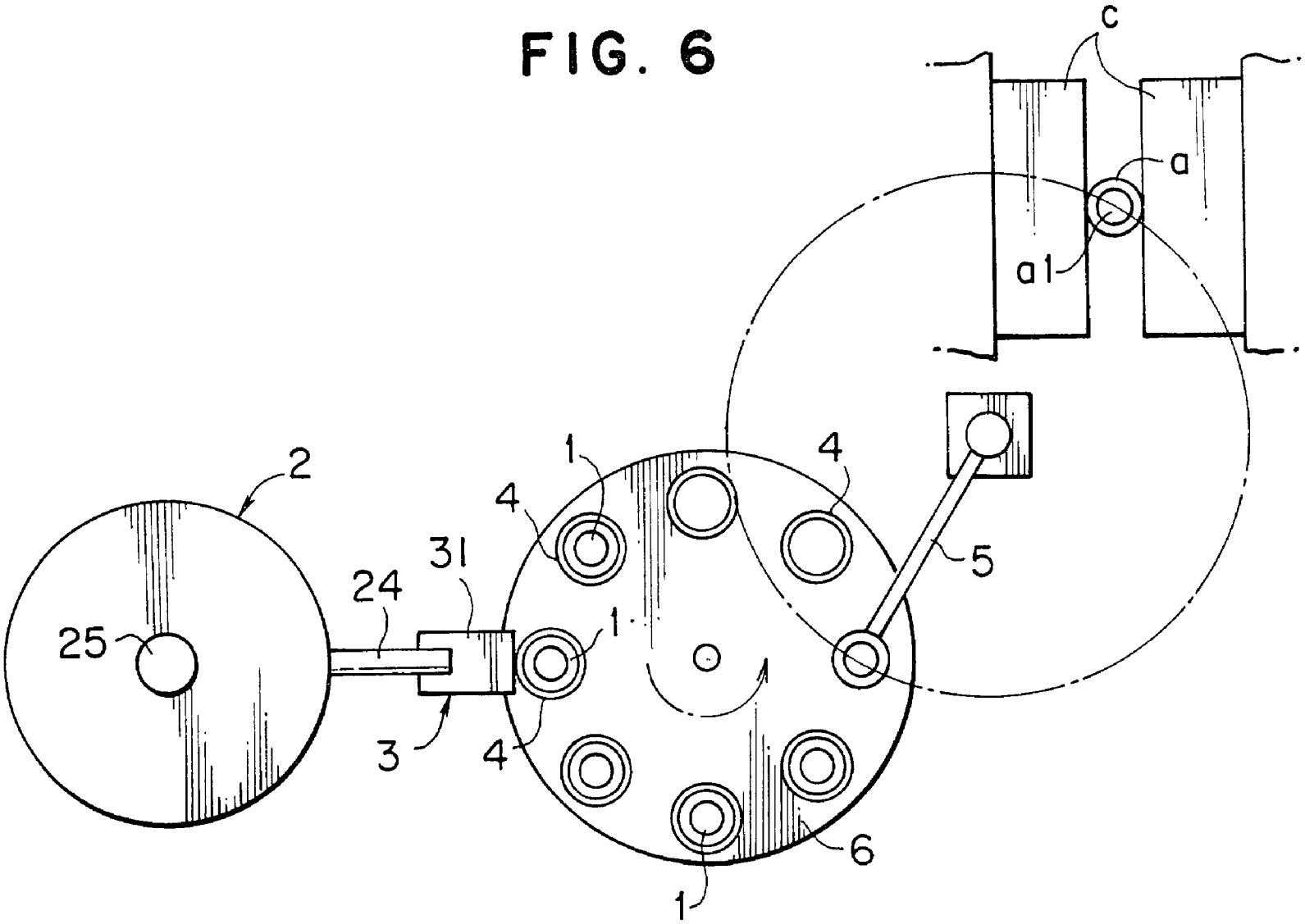
FIG. 6 is a schematic plane view of FIG. 5.

A preferable specific example is described below with reference to FIGS. 5 and 6.

In the figures, "2" represents a reservoir furnace to reserve melted metal "M0" of a given amount; "3" represents cooling device to apply a motion to the melted metal and concurrently cool at least a part of the melted metal "M0" at a temperature below the liquidus temperature; "4" represents a temperature control means to control the cooling rate of the melted metal "M1" placed in the slurry-preparing container "1"; "5" represents a feeding means to feed the semi-solid metal slurry prepared in the slurry-preparing container "1" into the shot sleeve/prechamber "a" of a part making machine; and "b" represents pressure piston inserted and interposed in the shot sleeve "a" in a sliding manner; "c" represents a mold of the part making machine; and "d" represents cavity.

The reservoir furnace "2", is structured, by placing and arranging graphite crucible "22" in electric furnace "21" well known, and connecting melted metal launder "24" equipped with heater "23" in communication with the graphite crucible "22". And the furnace "2" functions in such a manner that control rod "25" is immersed into the melted metal "M0" to freely control the feeding amount of the melted metal M0 on the basis of the immersed level of the control rod "25".

The cooling device "3" functions to apply a motion to the melted metal "M0", while cooling at least a part thereof at a temperature below the liquidus temperature through the flow of the melted metal "M0" poured from the melted metal launder "24" in the reservoir furnace "2". The cooling device "3" is formed into a plane shape or a trough shape (a tubular shape divided in halves along the axis direction) with smooth surface, or a pipe shape (tubular shape with a circle or a rectangle), by using a material of a copper plate coated by a material difficult to resolve or melt. And the cooling device "3" is arranged downward in a sloping manner, immediately below the port "24'" of the melted metal launder "24" in the reservoir furnace "2", in order that the melted metal "M0" can spontaneously flow down, and the surface thereof (face on which the melted metal "M0" is poured and then flow) is slope face "31".

As shown in the example, herein, the surface temperature of the slope face "31", to which the melted metal "M0" fed from the reservoir furnace "2" is in contact, should be controlled appropriately at a constant temperature, for example by providing cooling pipe (cooling system) "32" to circulate the cooling water to the cooling device "3". However, some structure of the cooling device "13" can be designed to eliminated the cooling system.

Figure 4:
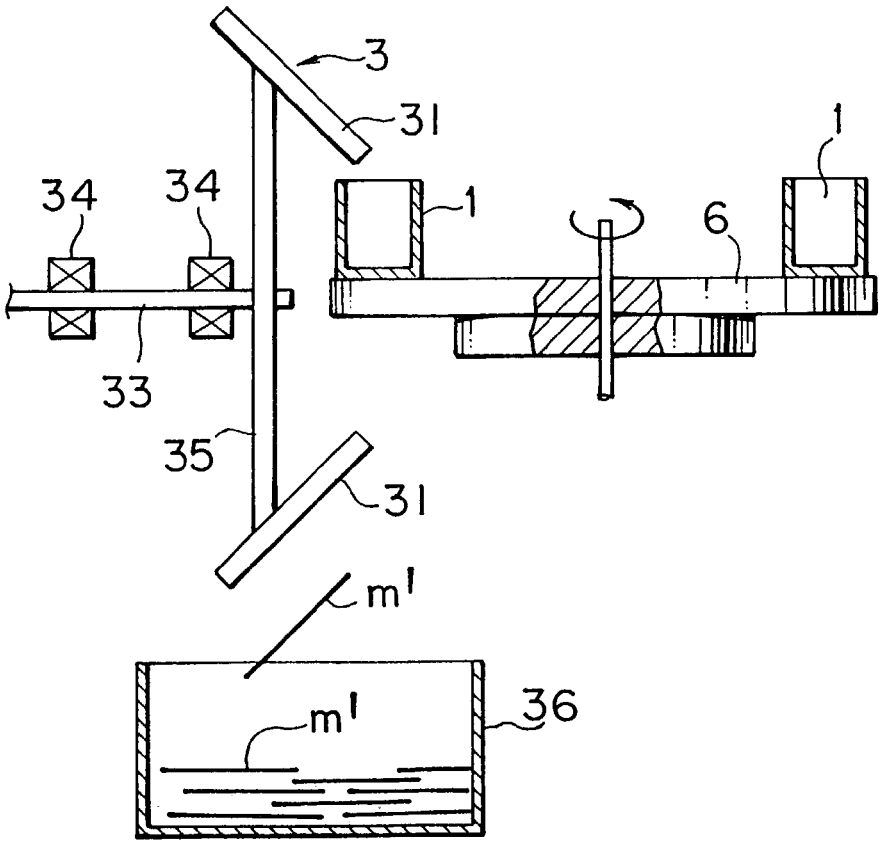
FIG. 4 is a schematic side view depicting one example of a cooling device in accordance with the present invention.

Furthermore, the cooling device "3" is provided with one slope face "31", satisfactorily, but the cooling device "3" is provided with plural slope faces "31", so that a given amount, for example an amount required for one shot of the melted metal is poured on one slope face and then the slope face is removed thereon, and subsequently, the next slope face is transferred to the pouring position so as to be used for next pouring, whereby the making cycle can be promoted. In this case, as shown in FIG. 4, one rotation axis "33" is horizontally arranged through bearing "34", and plural slope faces "31", "31", - - - , formed in a plane shape, a trough shape, or a pipe shape, through frame "35" are radially arranged on the tip of the rotation axis "33", and concurrently, the slope faces "31", "31", - - - are arranged in a slanting manner toward the core of the axis of the rotation axis "33", to structure the each slope faces "31", "31", - - - in a free rotation fashion around the rotation axis "33" as the center. By such structuring, no specific cooling system is needed to cool the individual slope face; and the plural slope faces 31, 31, - - - can be arranged in a narrow space. And even if the melted metal attaches and remains on the surface of the slope face "31" it will solidify and shrink while the metal is transferred downward to a lower position, so that the melted metal turns into thin metal piece "m'" and then falls spontaneously from the surface of the slope face "31" in recovery cage "36" when the piece is transferred to the lowest position. Thus, no problem occurs such as the melted metal attachment and residue on the slope face of the cooling device. And simultaneously, no problem occurs such as the attached and remained metal piece being remelted into a melted metal during the following pouring to consequently deteriorate the quality of the melted metal.

When melted metal "M1" is fed from the cooling device "3" into the slurry preparing container "1", an amount thereof required for one shot should be supplied in a quantitative manner. Then, the variation of the feeding amount of the melted metal required for one shot can be reduced less. Thus, no modification of making conditions based on the metal feeding amount is needed; and the inconvenience, which occurs when the melted metal in a semi-solid state with a high viscosity is divided into a given amount, can be overcome concurrently to make producing parts with stable quality possible.

Feeding means "5" to feed semi-solid metal slurry "M2" prepared in the slurry preparing container "1" into the shot sleeve/prechamber "a" of a part making machine possibly includes those of various mechanisms and structures, but in this example, a well-known robot hand is used.

For practical production, one slurry-preparing container "1" is satisfactorily used, but for efficient production, a plural slurry-preparing containers 1, 1, - - - , are preferably used. Then, slurry-preparing containers 1, 1, - - - are serially transferred to the side of a part making machine, so that semi-solid metal slurry "M2" might be fed into the shot sleeve/prechamber "a" of the part making machine just when the melted metal "M1" in the slurry-preparing container is at a given fraction solid.

More specifically, a rotation table as transfer means "6" capable of horizontal rotation is mounted between the cooling device "3" and the feeding means (robot hand) "5", and plural thermostat containers as the temperature control means "4" in a concentric manner are arranged on the transfer means (rotation table) "6". Then, after arranging the slurry-preparing container "1" in the temperature control means (thermostat container) "4" to preliminarily heat the inside of the slurry-preparing container around the temperature of the melted metal "M1", a given amount (for example, an amount required for one shot) of the melted metal "M1" is fed through the cooling device "3" into the slurry-preparing container "1".

By transferring the slurry-preparing container "1" to a given position by the rotation of the transfer means (rotation table) "6" along the horizontal direction, semi-solid metal slurry "M2" at a given fraction solid is prepared in the slurry preparing container. Just in time, then, the slurry-preparing container "1" is serially taken out by the robot hand as the feeding means "5", and is then transferred to the side of the part making machine, to feed the semi-solid metal slurry "M2" into the charge inlet "a1" of the shot sleeve/prechamber "a". The semi-solid metal slurry "M2" charged in the shot sleeve/prechamber a is filled under pressure through pressure piston "b" into cavity "d" of mold "c", in the same manner as carried out conventionally, to be made therein into a part.

Then, specific examples describe the performance of the melted metal applied with various motions when at least a part of the melted metal reaches a temperature below the liquidus temperature with no use of the cooling device as in the aforementioned example.

EXAMPLE 1

Example wherein a motion is applied to a melted metal placed in a slurry-preparing container by giving supersonic vibration from the outside wall of the slurry-preparing container;

As a melted metal, use was made of "AC4C", a JIS standard of cast aluminum alloys. The liquidus temperature of "AC4C" is about 610° C.

At 660° C., the melted metal of "AC4C" is poured into an iron-made slurry-preparing container which was structured in a tubular shape with a diameter of 63 mm and a height of 100 mm, and when the temperature of the melted metal at the center of the slurry-preparing container reached a given temperature (635° C. to 595° C.), a supersonic vibrator is put in contact with the exterior of the slurry-preparing container for 10 seconds, for vibrating the container, whereby a motion was applied to the melted metal therein.

Figure 7:
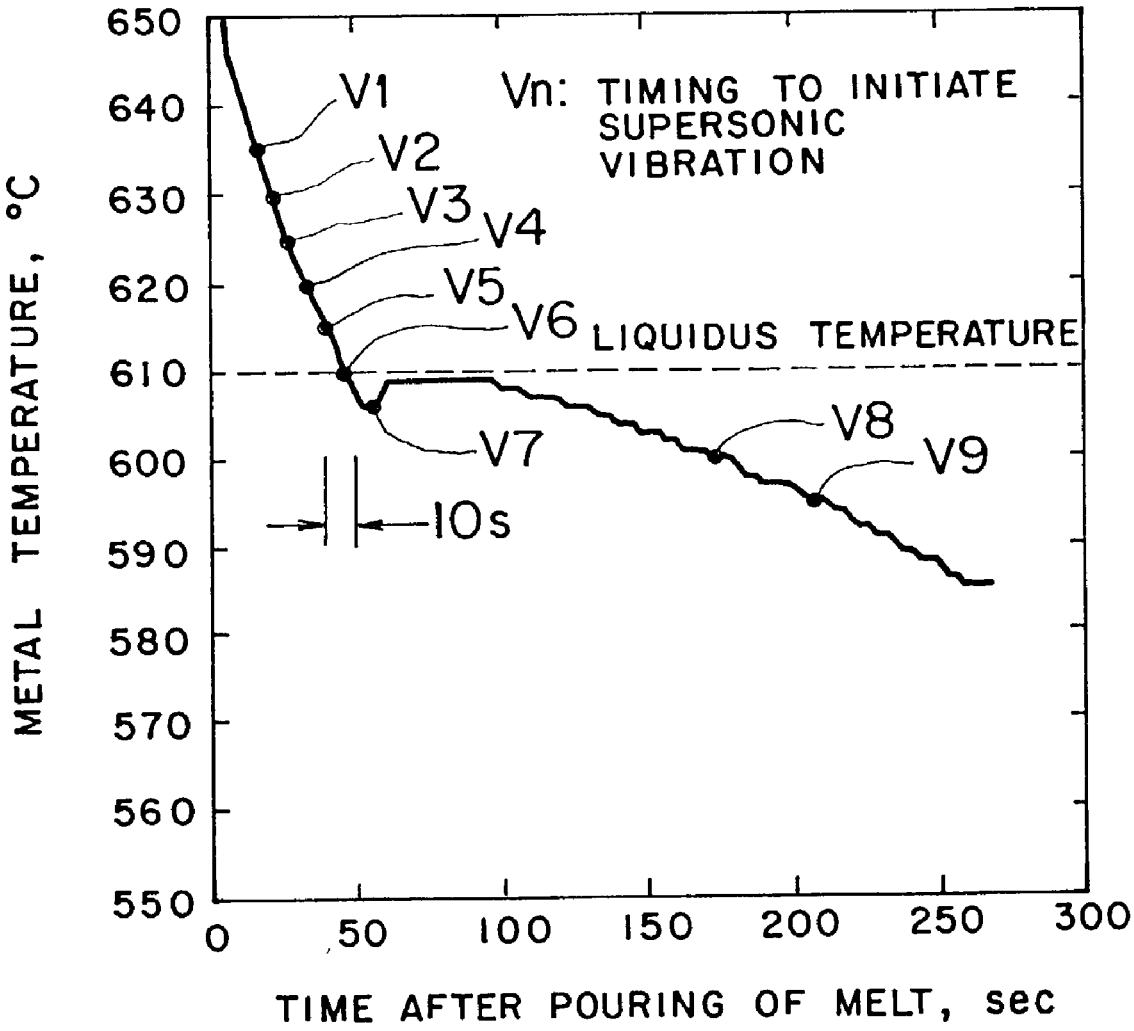
FIG. 7 represents the temperature change with time of the melted metal placed in the slurry-preparing container when a motion is applied to the melted metal by giving supersonic vibration to the melted metal placed in the slurry-preparing container from the outside wall of the slurry-preparing container, the time for applying supersonic vibration is shown in the graph.

FIG. 7 represents the time for applying supersonic vibration, on a graph depicting the temperature change with time of the melted metal placed in the slurry-preparing container, when a motion is to be applied to the melted metal by giving supersonic vibration to the outside wall of the slurry-preparing container.

Figure 8:
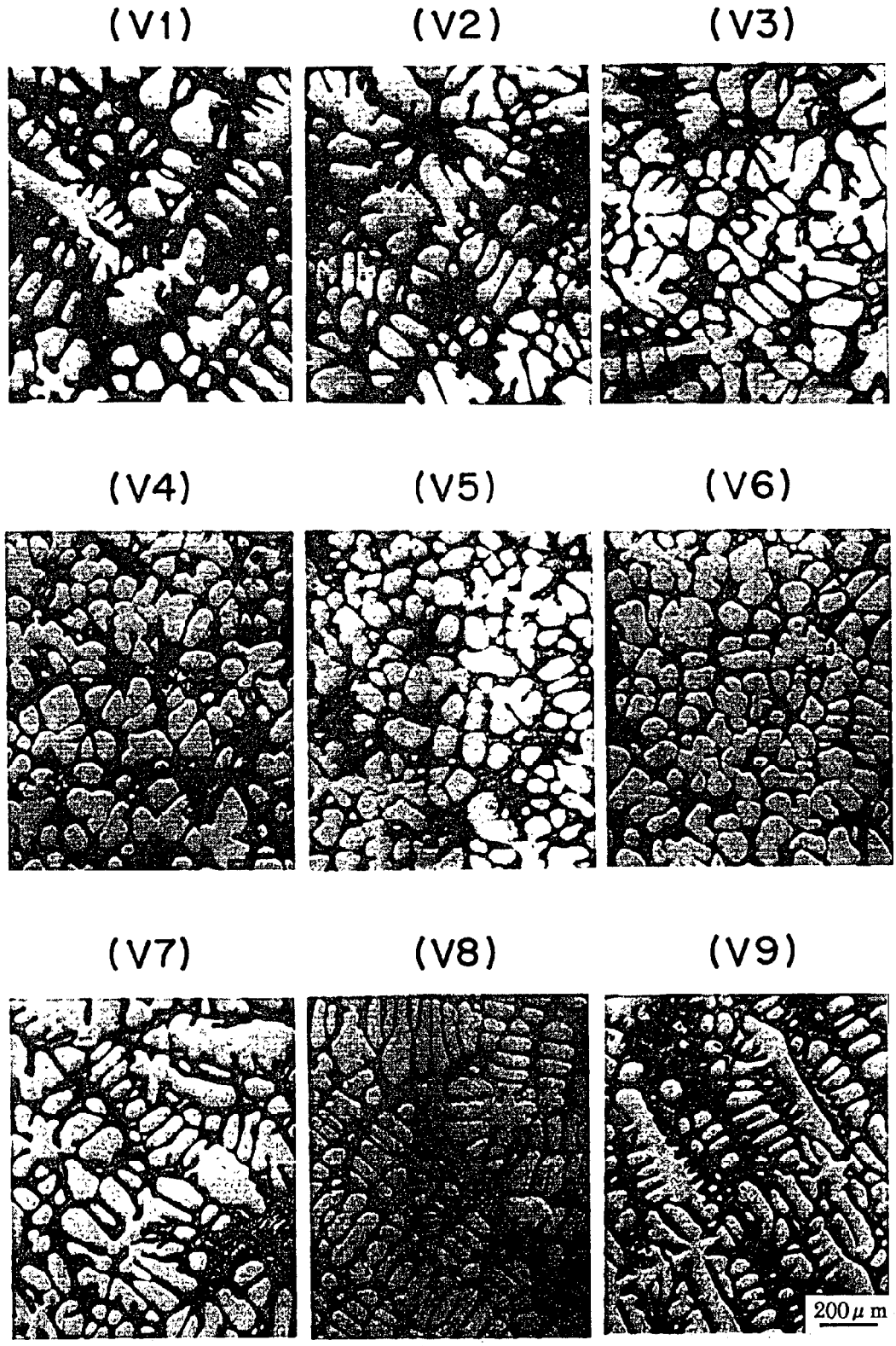
FIG. 8 depicts microscopic photographs of the metal microstructure obtained with applying of supersonic vibration at different times (V1 to V9) shown in FIG. 7.

After spontaneously cooling the melted metal applied with a motion through the supersonic vibration when the temperature reached 585° C., the melted metal was charged in water for rapid cooling, to observe the metal microstructure at the part for temperature measurement (center part). The resultant metal microstructure is shown in FIG. 8.

The temperature was measured at different positions of the melted metal placed in the slurry-preparing container (central part, peripheral part of the center, upper part and bottom part), at the initiation and termination of supersonic vibration. The results are shown in Table 1.

TABLE 1

| Central part | | Peripheral part | | Upper part | | Bottom part | |
|---|---|---|---|---|---|---|---|
| Initiation tem. | Termination tem. | Initiation tem. | Termination tem. | Initiation tem. | Termination tem. | Initiation tem. | Termination tem. |
| 629° C. | 615° C. | 628° C. | 614° C. | 624° C. | 616° C. | 620° C. | 608° C. |
| 625° C. | 614° C. | 625° C. | 613° C. | 624° C. | 615° C. | 618° C. | 607° C. |
| 620° C. | 611° C. | 618° C. | 610° C. | 620° C. | 612° C. | 612° C. | 606° C. |
| 615° C. | 605° C. | 614° C. | 604° C. | 616° C. | 605° C. | 608° C. | 604° C. |
| 609° C. | 608° C. | 609° C. | 608° C. | 611° C. | 606° C. | 606° C. | 607° C. |
| 605° C. | 609° C. | 606° C. | 610° C. | 606° C. | 607° C. | 606° C. | 607° C. |

Figure 9:
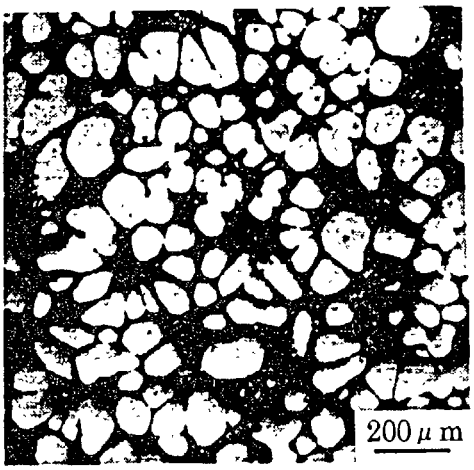
FIG. 9 depicts microscopic photographs of the metal microstructure obtained with applying of supersonic vibration at the time of V4 (620° C.) for 20 seconds as shown in FIG. 7.
Figure 10:
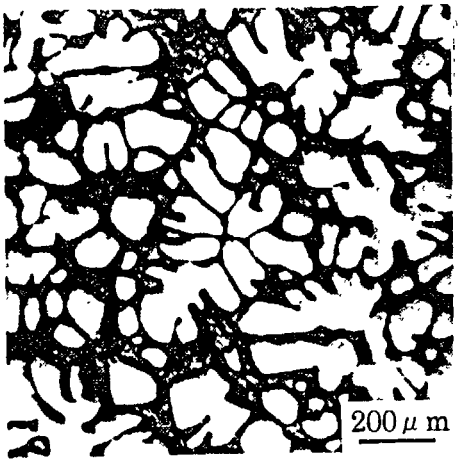
FIG. 10 depicts microscopic photographs of the metal microstructure obtained with applying of supersonic vibration at the time of V5 (615° C.) or 5 seconds as shown in FIG. 7.
Figure 11:
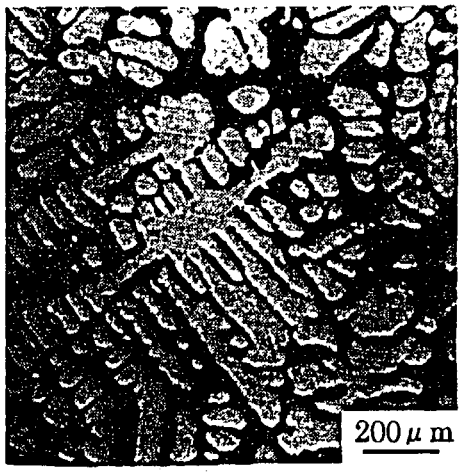
FIG. 11 depicts microscopic photographs of metal microstructure with no applying of supersonic vibration.

For reference only, FIGS. 9 to 11 depict microscopic photographs of metal microstructure after 20-sec supersonic vibration, 5-sec supersonic vibration and no applying of supersonic vibration, at the temperature of the V4(620° C.).

In the microscopic photograph shown in FIG. 8, a part observed as slightly white represents the primary crystal; and a part observed as slightly black represents the eutectic mixture. (The same is true with the following microscopic photographs showing the metal microstructure.)

Under observation of these metal microstructures, supersonic vibration applied at time V1 (the temperature then, namely the temperature of the melted metal just when supersonic vibration is applied, is 635° C.; temperature alone is simply shown below), the metal is of an entire dendritic structure; at the time V2 (630° C.), the resultant dendrite is of a more or less disordered shape; at the time V3 (625° C.), partial granulation occurs in the resultant metal with the wholly short dendrites; and at the time V4 to V6 (620° C. to 610° C.), no dendritic structure was observed so that the metal is totally in granules. At the time V7 (605° C.), the extent of granulation is less, involving partial appearance of such dendritic structure, while at the time V8 to V9 (600° C. to 595° C.), the whole metal is of a dendritic structure.

Figure 12:
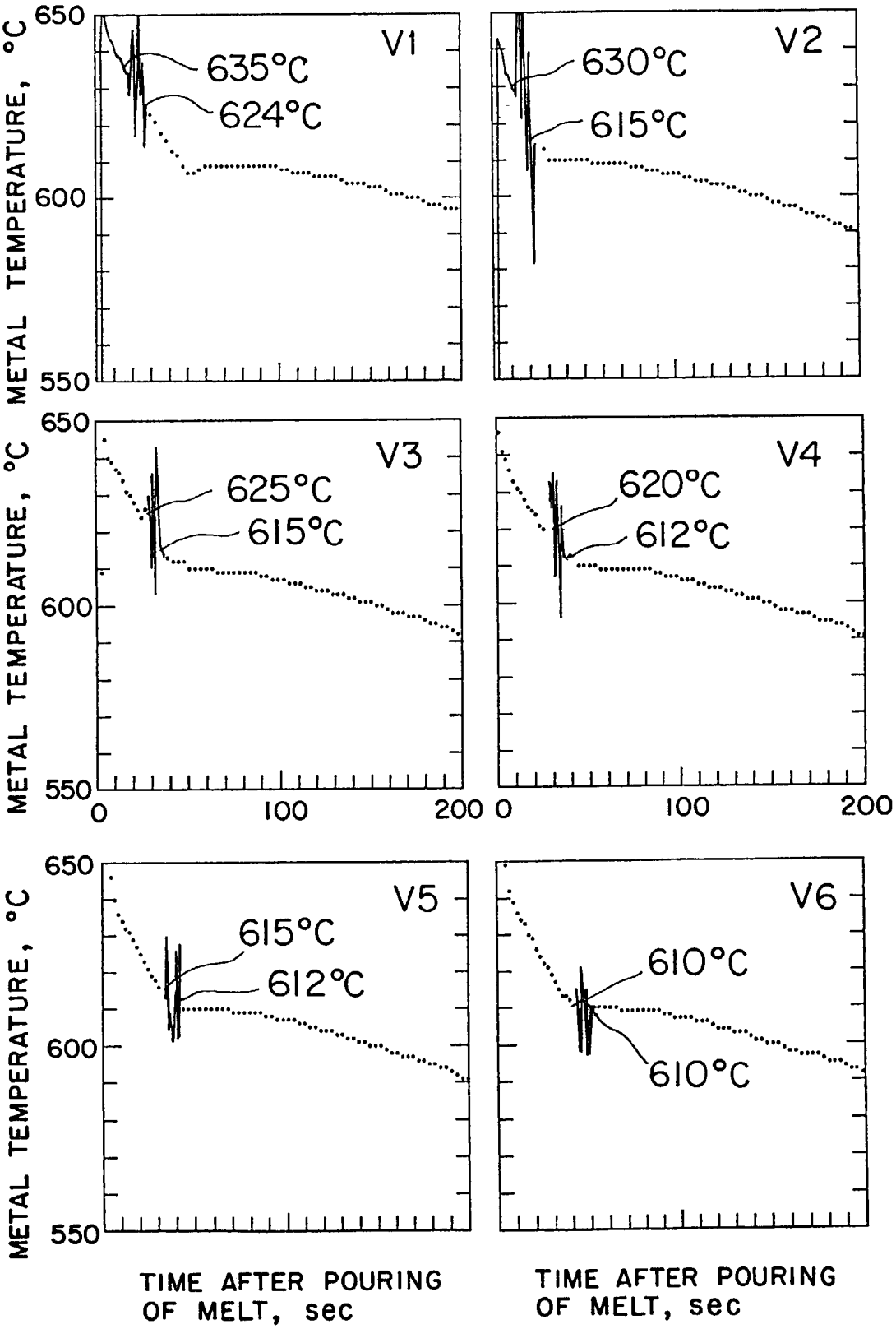
FIG. 12 is a graph depicting the temperature change with time of the melted metal applied with supersonic vibration.

Under further observation of such microstructure, the metal microstructure is modified under applying of supersonic vibration when the temperature of the center of the melted metal placed in the slurry-preparing container reaches about 630° C. (629° C. at the time of initiation of supersonic vibration and 615° C. at the time of termination). As shown in Table 1 above, this may be because of the following influence on the change of metal microstructure; each part of the melted metal in the slurry-preparing container are at different temperatures, such as about 630° C. at the center of the melted metal, despite of about 620° C. at the bottom part (620° C. at the time of initiation of supersonic vibration and 608° C. at the termination of supersonic vibration) below the liquidus temperature (610° C.). A wholly well granulated microstructure was obtained when supersonic vibration was applied at 620° C. to 610° C. at the center. In this case, any part (center, peripheral part of the center, upper part and bottom part) is at a temperature below the liquidus temperature. When supersonic vibration is applied at 605° C. at the center, alternatively, any of the places already have passed through a temperature below the liquidus temperature, and therefore, the extent of granulation is poorer. Under observation of the temperature change with time of the melted metal applied with supersonic vibration as shown in FIG. 12, the undercooling phenomenon was observed under applying of supersonic vibration at time V1 (635° C.), but no appearance of any under cooling phenomenon was observed under applying of supersonic vibration at time V2 (630° C.) to V6 (610° C.). Herein, noises appearing on the measured curve may be due to the influence of supersonic wave.

EXAMPLE 2

Figure 13:
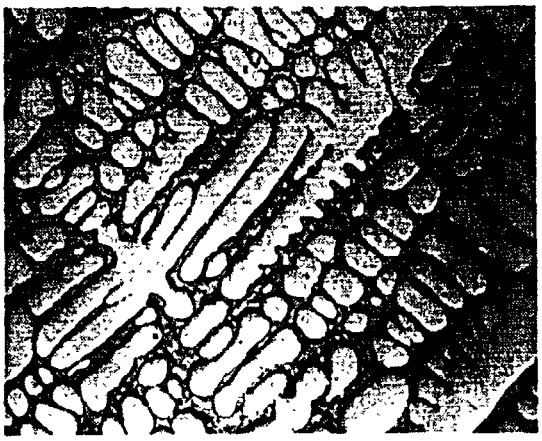
FIG. 13 depicts microscopic photographs of the metal microstructure obtained with applying of a motion through mechanical stirring of the melted metal.
Figure 13:
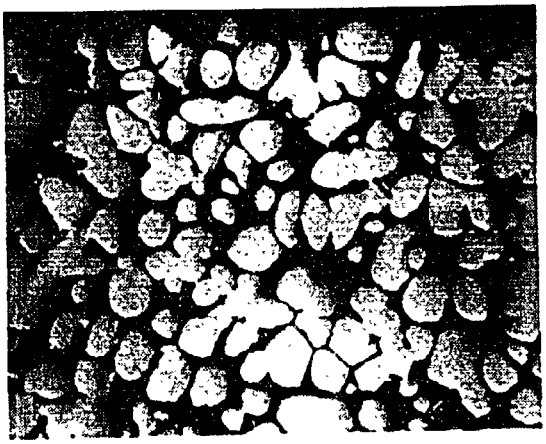
Figure 13:
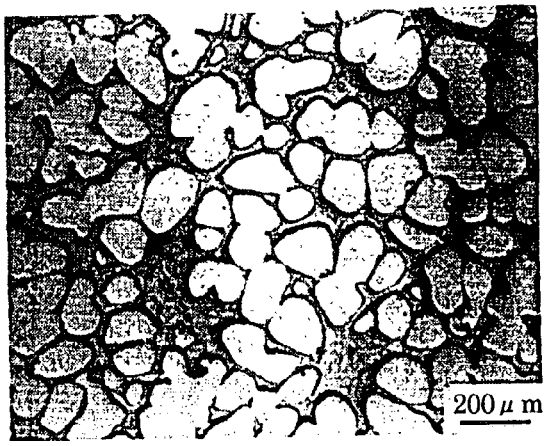

Example wherein a motion is applied on a melted metal placed in a slurry-preparing container by mechanically stirring the melted metal;

At 650° C., the same melted metal (AC4C) as in Example 1 was poured into a thermal insulation container formed in an approximately tubular shape of a diameter of 63 mm and a height of 100 mm, to examine (a) a case wherein the melted metal was mechanically stirred with a ceramics stirring rod by hands when the melted metal was at a temperature between 620° C. to 611° C. (for 39 seconds) and (b) a case wherein the melted metal was similarly stirred when the melted metal reached the liquidus temperature. By spontaneously cooling the melted metals (a) and (b) when the melted metals reached 585° C., the metals were charged into water and were rapidly cooled therein. The metal microstructure was observed. Microscopic photographs of the resultant metal microstructure are shown in FIG. 13.

Under observation of these metal microstructure, the shape of the primary crystal was a fully developed dendritic shape when the melted metal was at a temperature between 620° C. to 611° C. However, the shape of the primary crystal was in complete granulation when stirring was carried out at the liquidus temperature.

Figure 14:
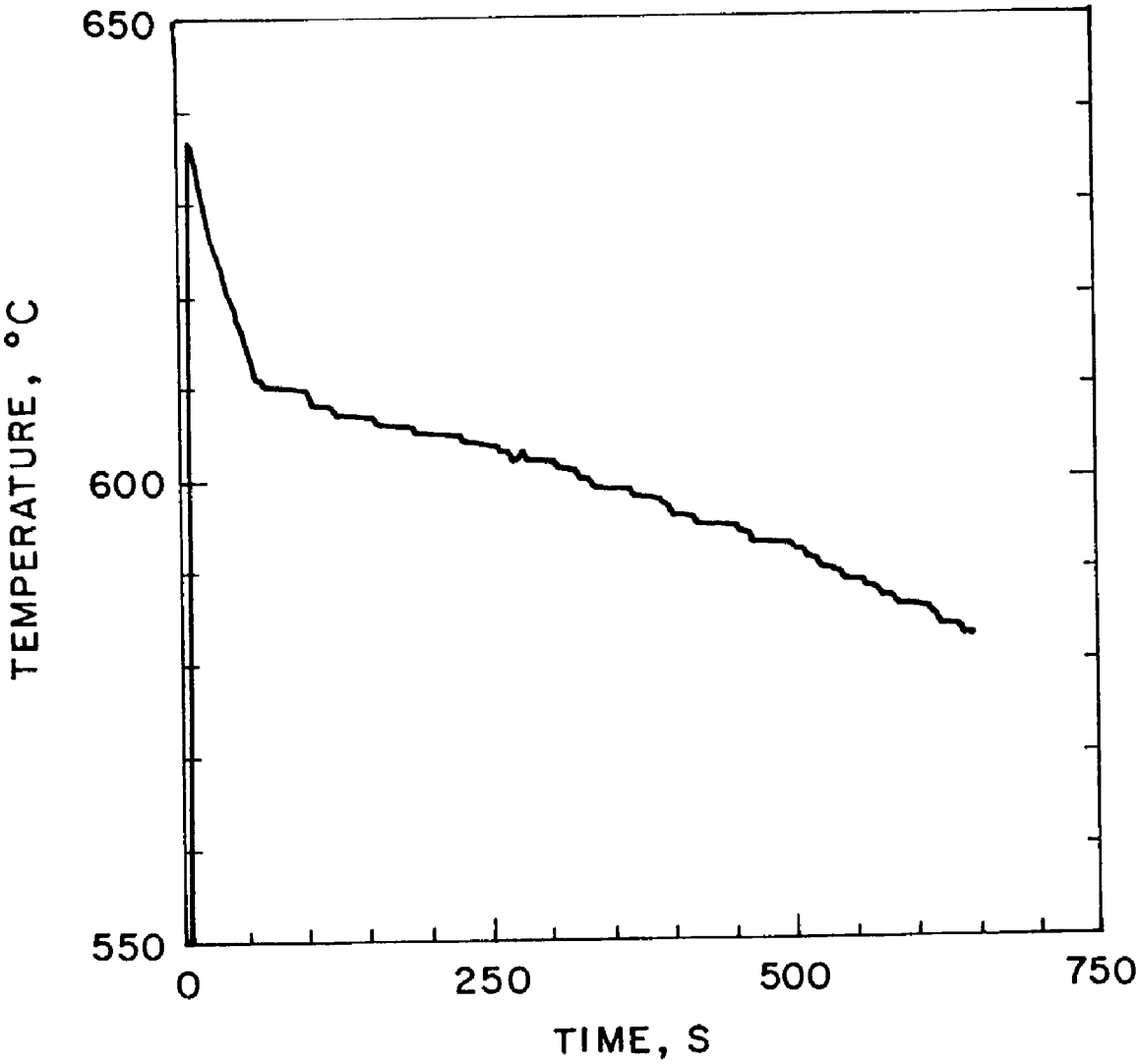
FIG. 14 is a graph depicting the temperature change with time of the melted metal placed in the slurry-preparing container, when a motion is applied to the melted metal through mechanical stirring.

In the present Example, the temperature change of the melted metal at the center of slurry-preparing container with time is shown in FIG. 14. In the present Example, a thermal insulation material was used for the slurry-preparing container, and the cooling rate of the melted metal in the slurry-preparing container was substantially slow, compared with the previous Example. It is therefore suggested that the temperature distribution in the melted metal is more uniform. Practically, the melted metal was at the liquidus temperature at the termination of the stirring (10 seconds after the liquidus temperature was reached), which possibly indicates that the temperature of the whole melted metal was almost uniform. Under the conditions described in (a), a dendritic structure was formed because any part in the slurry-preparing container was not below the liquidus temperature. On the other hand, under the conditions described in (b), the entirety was at the liquidus temperature so the shape of the primary crystal was in complete granulation. This apparently indicates that stirring of the melted metal at the liquidus temperature, namely applying of a motion to the melted metal at the liquidus temperature, results temperature, results in the granulation of the primary crystal.

These results of observation apparently indicate that the time for applying a motion to the melted metal is preferably the time when at least a part of the melted metal in the course of cooling is at the liquidus temperature or below the temperature (within a range of 620° C. to 610° C. in the present Example), and the (duration) extent of the motion applied is about 10 seconds of supersonic vibration or about 10 seconds of mechanical stirring. Consequently, the entirely granulated metal slurry with no dendritic structure is obtained.

Herein, it was examined that how the cooling rate of the melted metal at the nucleation of the primary crystal after the motion was applied to the melted metal affected the shape of the primary crystal.

Figure 15:
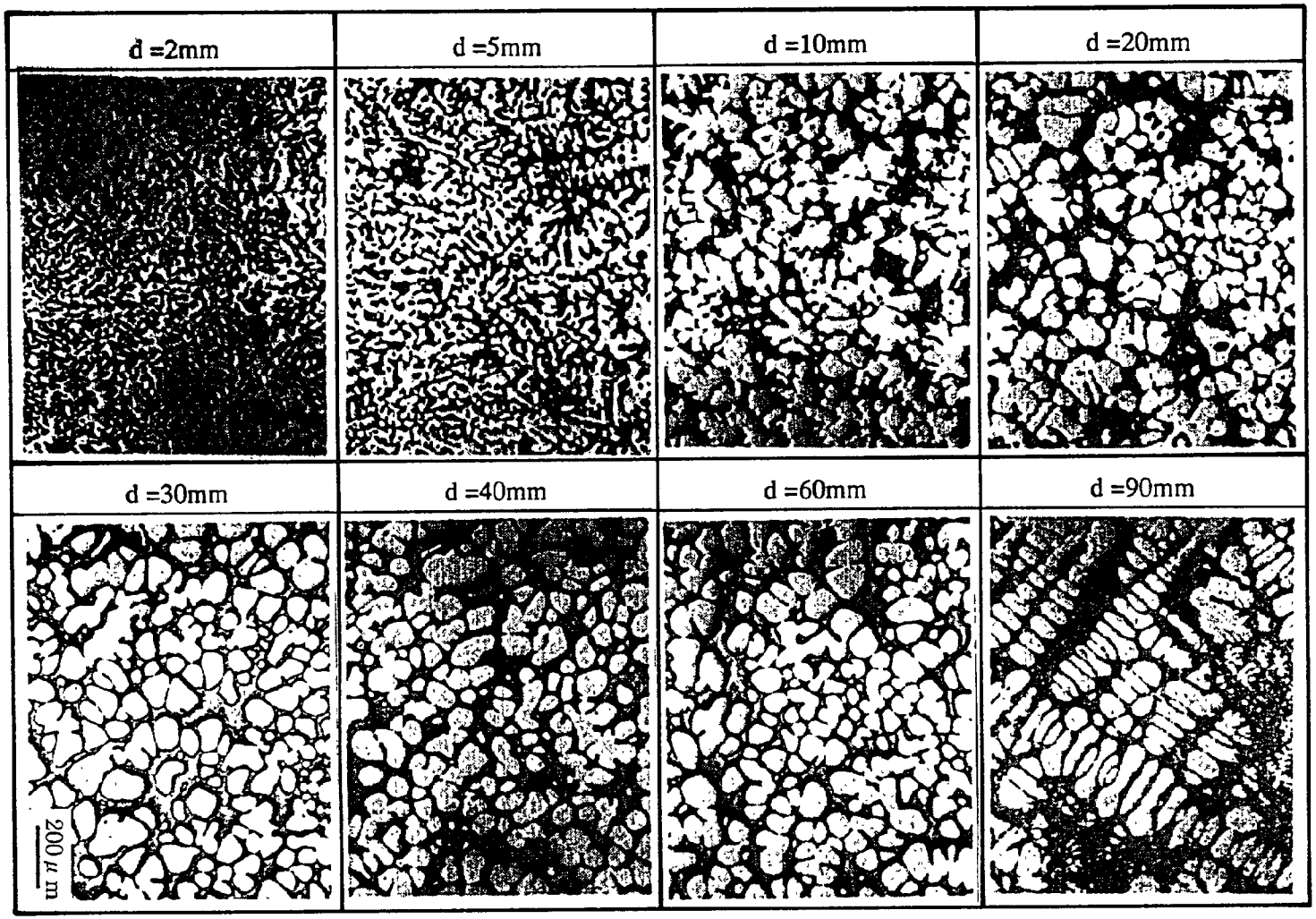
FIG. 15 depicts microscopic photographs of the metal microstructure of the melted metal placed in the slurry-preparing container when the melted metal is poured into the slurry-preparing container.

As a slurry-preparing container, use was made of a tube of an inner diameter of 63 mm and a height of 100 mm, being made of a thermal insulation material, where an iron block kept at 200° C. was arranged on the bottom. The same melted metal (AC4C) as in Example 1 was poured into the slurry-preparing container at 620° C., and then, the melted metal temperature of different distances from the bottom (h=2, 10, 20, 40, 70, 90 mm) was measured at the central region of the slurry-preparing container. Then, by spontaneously cooling the melted metal and when the melted metal reached 520° C., the metal was charged into water for rapid cooling, to observe the metal microstructure of the different positions where the temperature was measured. The metal microstructure thus obtained is shown in FIG. 15.

Under observation of these metal microstructure, the shape of the primary crystal varies depending on the distance from the bottom. More specifically, a fine dendrite appeared in the region of h<10 mm; a part of the dendrite was transformed into granular structures in the region of h=10 to 30 mm; a entirely granulated structure developed in the region of 30<h<80 mm; and a coarse dendritic structure appeared at h>90 mm. As described above, the variation of the shape of the primary crystal depending on the distance (d) from the bottom which contacts with the iron block is apparently due to the difference in the cooling rate of the melted metal inside the slurry preparing container.

Figure 16:
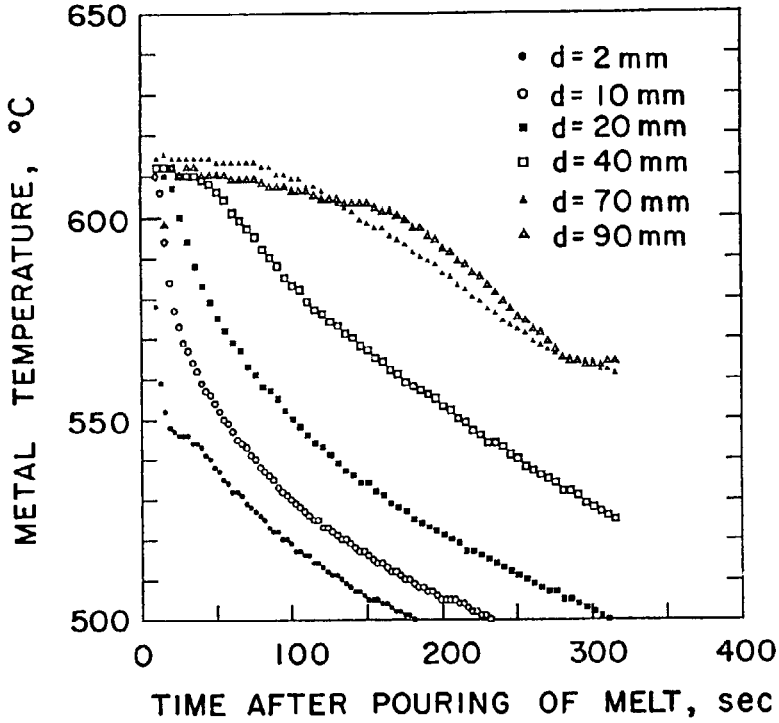
FIG. 16 is a cooling curve depicting the temperature change of the melted metal vs. cooling time, at different positions in the slurry-preparing container when the melted metal is poured into the slurry-preparing container.
Figure 17:
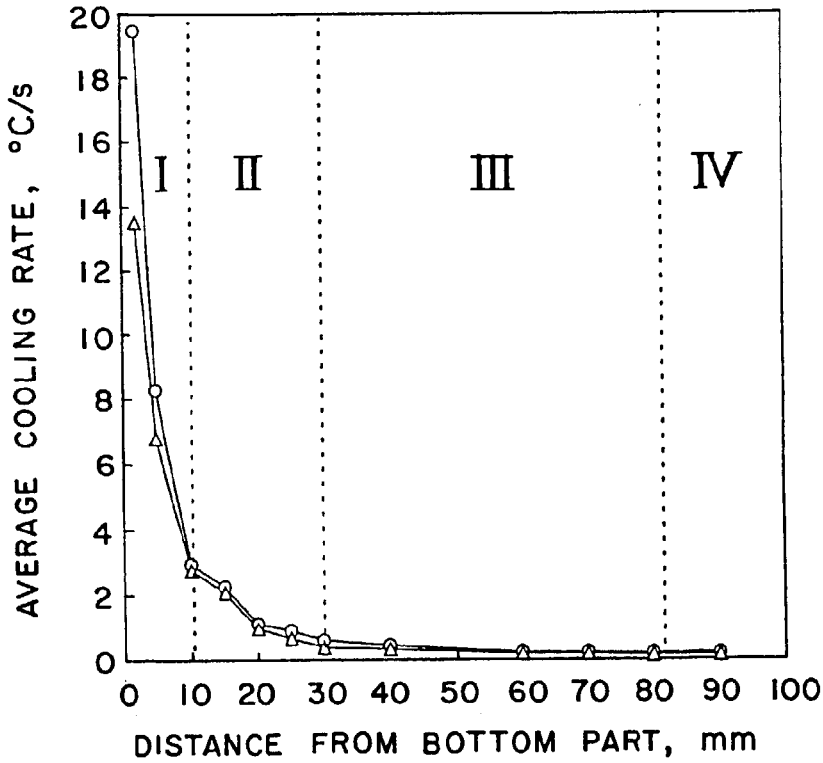
FIG. 17 is a graph plotting the distance from the bottom of the metal vs. the average cooling rate calculated within a temperature range from the liquidus temperature to a temperature where the solidification of a eutectic mixture initiates, when the melted metal is poured into the slurry-preparing container.

FIG. 16 shows cooling curves at different positions (temperature change of melted metal vs. time). In FIG. 16, the cooling rate was decreased at a longer distance (d) from the bottom of the melted metal. It is elucidated that the growth of the primary crystal occurs within a range from the liquidus temperature to the temperature at which the solidification of the eutectic mixture initiates. Thus, the average cooling rate was calculated within the range from the liquidus temperature to the temperature at which the solidification of the eutectic mixture was initiated, which was then plotted with the distance (d) from the bottom of the melted metal on a graph as shown in FIG. 17.

The graph can be divided into 4 regions, depending on the shape of the primary crystal. More specifically, (I) represents a region of cooling rate (CR>2.75° C./sec) for forming a fine dendritic structure ; (II) represents a region of cooling rate (2.75° C.>CR>0.4° C./sec) for forming a transition region of the dendritic structure into a granular structure; (III) represents a region of cooling rate (CR<0.4° C./sec) for forming the granular structure; and (IV) represents a region of cooling rate for forming an enlarged dendritic structure. These results of observation indicate that a entirely granulated metal slurry with no dendritic structure can be obtained by cooling the melted metal at a cooling rate of 3° C./sec or less, preferably 0.4° C./sec or less.

Herein, the primary crystal structure with the dendritic morphology, prepared in the regions (I) and (II), was granulated under reheating within a range of semi-solid temperature, to prepare a granular structure of the same size as that of the metal microstructure prepared in the region (III).

EXAMPLE 3

Figure 18:
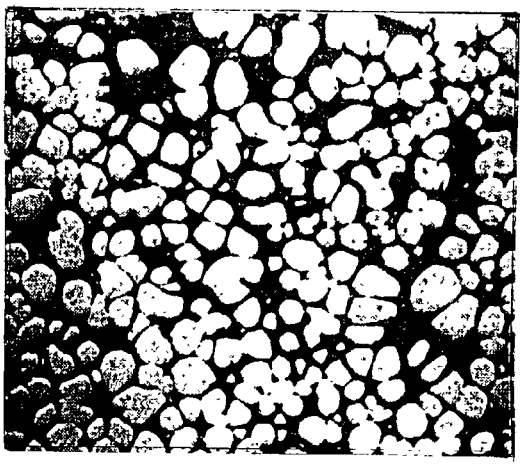
FIG. 18(*a*) depicts a microscopic photograph of the metal microstructure when the melted metal is poured into the slurry-preparing container; and (b) depicts a microscopic photograph of the metal microstructure when the melted metal in (a) is further stirred with a high frequency induction stirring apparatus.
Figure 18:
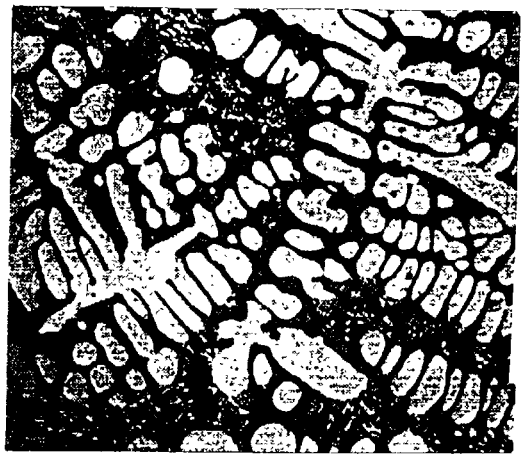
Figure 18:
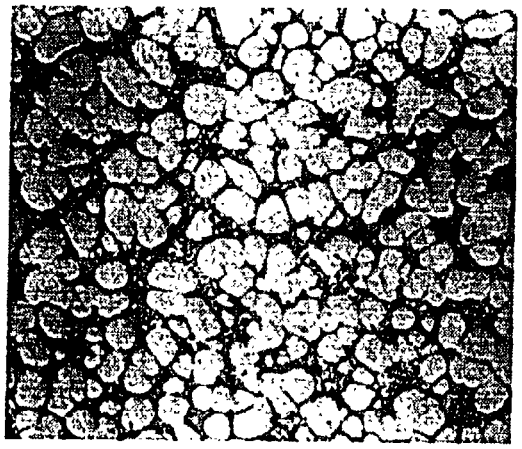
Figure 18:
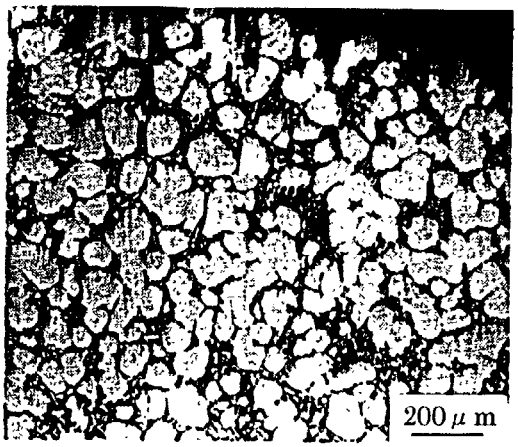

Example wherein a combination of two kinds of motions was applied to the melted metal;

At 620° C., the same melted metal (AC4C) as in Example 1 was used and (a) poured into a thermal insulation container formed in an approximately tubular shape with a diameter of 63 mm and a height of 100 mm, thereby applying a motion to the melted metal, and (b) by stirring then the melted metal with a high frequency induction stirring system for 10 seconds, a motion was applied to the melted metal. Thereafter, when the melted metal reached 585° C., the melted metal was charged into water for rapid cooling, to observe the metal microstructure in the center and superficial layer region, respectively. The metal microstructure thus obtained is shown in FIG. 18. Under observation of such metal microstructure, the primary crystal was granulated in the metal microstructure at the center, while the metal microstructure in the superficial layer was in a dendritic shape, with no stirring with the high frequency induction stirring system, and while the microstructure was in granulation up to the superficial layer stirred with the high frequency induction stirring system.

The reason why the dendritic shape was formed without the high frequency induction stirring is that the slurry-preparing container was heated during pouring of the melted metal, so that the temperature of the melted metal during the final pouring would not decrease less than the liquidus temperature of the melted metal. It was whereby assumed that a motion (pouring motion) was applied to the melted metal in the superficial layer region at a state of a temperature higher than the liquidus temperature and then, the structure in this region was prepared into a dendritic morphology. This is apparently shown in that the melted metal was granulated by pouring the metal into the slurry-preparing container and further stirring the metal with the high frequency induction stirring system, thereby applying motions to the metal. It is apparently shown that the melted metal was granulated when the melted metal in the superficial layer was applied with a motion when the metal reached a temperature below the liquidus temperature, so that the microstructure of the melted metal was granulated.

As has been described above, by the semi-solid making method of the present invention, a metal slurry of the primary non-dendritic (granulated) crystal particles being fine and almost uniform can be fed in a stable manner into a part making machine, to make a shaped part with high quality in a stable fashion, without specific need of complicated equipment. Additionally, an amount of a melted metal can be determined in its liquid state, and by cooling the melted metal thereafter in a slurry preparing container, a metal slurry in a semi-solid state can be prepared. The resultant metal slurry at a high fraction solid, as it is as prepared in the slurry preparing container, can be fed into the shot sleeve/prechamber of a part making machine, with no transfer of the slurry into another container, so that the following disadvantages with a conventional method by a rheomaker can be almost eliminated; the sharply cutting of the semi-solid metal slurry is difficult, including the difficulty in the determination of the amount of the semi-solid slurry thereof; the semi-solid metal slurry is attached and is deposited on the slurry discharge outlet of the rheomaker, to immediately cause poor operations of the opening and closing valve; the prepared semi-solid metal slurry has such an inconstant shape that the charging thereof into the shot sleeve/prechamber of a part making machine is difficult. This involves the difficulty in stable feeding of the semi-solid metal slurry, leading to a variation in the feeding amount of the semi-solid metal slurry, whereby the processing conditions thereof are changed, so that the quality of the parts is not stable; and the temperature control until the semi-solid metal slurry produced in the rheomaker is charged into the shot sleeve/prechamber of a part making machine is difficult. Therefore, no specific system such as rheomaker is needed, so that the system construction of the present invention can be relatively simplified.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A method of preparing a semi-solid metal slurry and delivering said semi-solid metal slurry to a shot sleeve/prechamber of a molding machine which comprises:

(a) pouring a predetermined amount of a metal melt into a slurry-preparing container, (b) cooling said metal melt in said slurry-preparing container at a rate of no more than 3° C./second to convert said metal melt into said semi-solid metal slurry, (c) generating motion in said metal melt using mechanical or physical means while a portion thereof reaches a temperature below a liquidus temperature of said metal during step (b), and (d) delivering said slurry-preparing container with semi-solid metal slurry therein into the shot sleeve/prechamber of the molding machine for molding into a shaped product.

2. A method according to claim 1, wherein said mechanical or physical means is selected from stirring, ultrasonic vibration and frequency, induction.

3. A method of preparing a semi-solid metal slurry and delivering said semi-solid metal slurry to a shot sleeve/prechamber of a molding machine which comprises:

(a) pouring a predetermined amount of a metal melt into a slurry-preparing container, (b) cooling said metal melt in said slurry-preparing container to convert said metal melt into said semi-solid metal slurry, (c) generating motion in said metal melt using mechanical or physical means while a portion thereof reaches a temperature below a liquidus temperature of said metal during step (b), and (d) delivering said semi-solid metal slurry out of said slurry-preparing container into the shot sleeve/prechamber of the molding machine for molding into a shaped product.

4. A method according to claim 3, wherein said mechanical or physical means is selected form stirring, ultrasonic vibration and frequency induction.

5. A method of preparing a semi-solid metal slurry and delivering said semi-solid metal slurry to a shot sleeve/prechamber of a molding machine which comprises:

(a) pouring a predetermined amount of a metal melt into a slurry-preparing container while concurrently creating motion in said metal melt, wherein a temperature of the metal melt before pouring is controlled in such a way that a portion of said metal melt reaches a temperature below a liquidus temperature when said metal melt comes in contact with said slurry-preparing container during the pouring operation, (b) cooling said metal melt in said slurry-preparing container to convert said metal melt into said semi-solid metal slurry, and (c) delivering said slurry-preparing container with semi-solid metal melt slurry therein into the shot sleeve/prechamber of the molding machine for molding into a shaped product.

6. A method according to claim 5, wherein a rate of cooling of the semi-solid metal slurry in the slurry-preparing container is 3° C./second or less.

* * * * *